United States Patent [19]

Klomp

[11] Patent Number: 4,945,868

[45] Date of Patent: Aug. 7, 1990

[54] TWO CYCLE EXHAUST RECYCLING

[75] Inventor: Edward D. Klomp, Mount Clemens, Mich.

[73] Assignee: General Motors Corporation, Detroit, Mich.

[21] Appl. No.: 369,225

[22] Filed: Jun. 21, 1989

[51] Int. Cl.[5] ..... F02B 25/20

[52] U.S. Cl. ..... 123/65 PE; 123/323; 60/314

[58] Field of Search ..... 123/65 P, 65 PE, 65 EM, 123/323; 60/313, 314

[56] References Cited

U.S. PATENT DOCUMENTS

| | | | |
|---|---|---|---|
| 4,312,308 | 1/1982 | Slattery | 123/65 EM |
| 4,386,587 | 6/1983 | Simko | 123/65 A |
| 4,541,371 | 9/1985 | Kageyama et al. | 123/65 PE |
| 4,622,928 | 11/1986 | Uchinishi | 123/65 PE |
| 4,682,571 | 7/1987 | Kaufman et al. | 123/73 A |
| 4,848,279 | 7/1989 | Luo | 60/314 |

FOREIGN PATENT DOCUMENTS

| | | | |
|---|---|---|---|
| 2927521 | 1/1981 | Fed. Rep. of Germany | 123/65 PE |
| 0156924 | 8/1985 | Japan | 123/65 PE |
| 0156925 | 8/1985 | Japan | 123/65 PE |
| 0272916 | 11/1988 | Japan | 123/65 PE |
| 1016545 | 5/1983 | U.S.S.R. | 123/65 PE |

*Primary Examiner*—David A. Okonsky
*Attorney, Agent, or Firm*—Robert J. Outland

[57] ABSTRACT

A crankcase scavenged two cycle engine has an auxiliary or bypass port above the exhaust and inlet ports to direct blowdown exhaust gas into a plenum or the engine crankcase for later return to the engine cylinder. Loss of fuel-rich blowdown gas to the engine exhaust system is thereby reduced.

9 Claims, 4 Drawing Sheets

TWO CYCLE EXHAUST RECYCLING

TECHNICAL FIELD

This invention relates to two cycle engines with crankcase scavenging and in particular to the recycling or other handling of portions of the exhaust gases in such engines.

BACKGROUND

In a crankcase scavenged engine with intake and exhaust porting, the timings of the port events are symmetrical, with the exhaust opening first and closing last. There is reason to believe that the blowdown process occurring when the exhaust port first opens is richer in unburned or partially burned fuel. During exhaust port closing fresh charge is lost to the exhaust reducing the average temperature of the exhaust, the effective compression ratio and the fraction of fresh charge trapped compared to total charge supplied. It is the intent of this invention to improve at least some of these aspects of conventional porting.

SUMMARY OF THE INVENTION

The present invention provides a crankcase scavenged two cycle engine having an auxiliary or bypass port above the exhaust and inlet ports to direct blowdown exhaust gas into a plenum or the engine crankcase for later return to the engine cylinder. Loss of fuel-rich blowdown gas to the engine exhaust system is thereby reduced.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
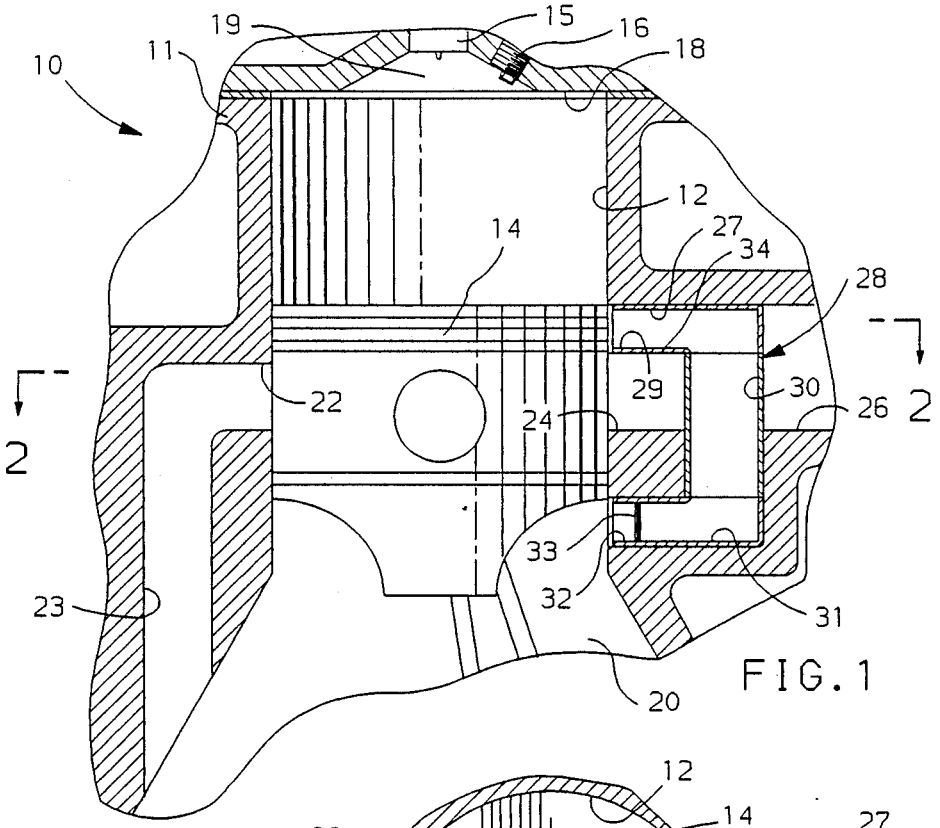
FIG. 1 shows schematic cross-sectional view of an engine with port bypass means according to the invention.
Figure 2:
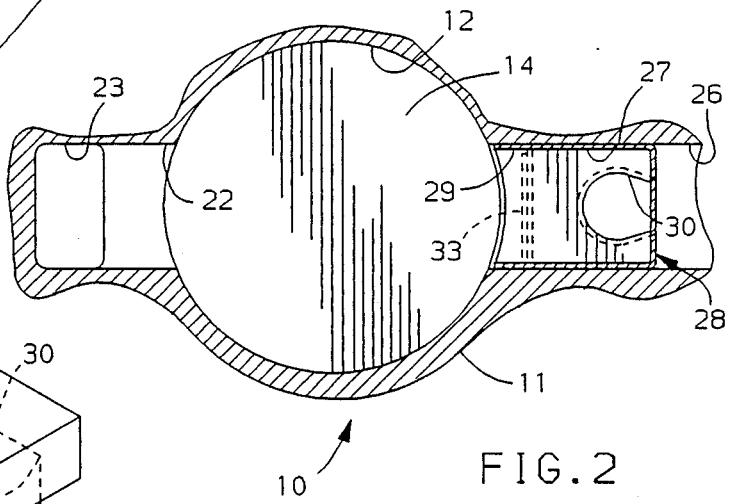
FIG. 2 is a schematic top view of the engine.
Figure 3:
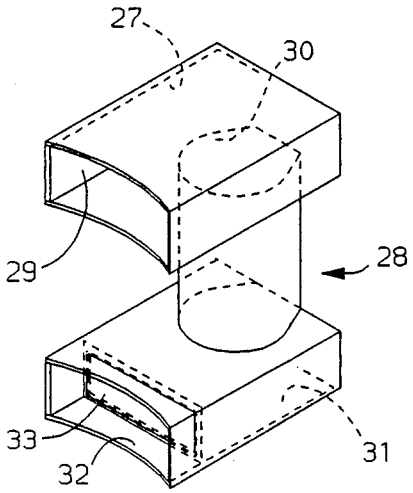
FIG. 3 is a schematic pictorial view of the port bypass means.

Referring now to the drawings in detail, FIGS. 1–3 show a two cycle crankcase scavenged spark ignition engine generally indicated by numeral 10. The engine has a block 11 defining a closed end cylinder 12 in which is a reciprocable piston 14. A fuel injector 15 and spark plug 16 are preferably provided at the closed end 18 of the cylinder which cooperates with the piston to define a working and combustion chamber 19. A crankcase chamber 20 is provided at the open end of the cylinder which contains a crank mechanism, not shown, connected with the piston for movement therewith in conventional manner.

Intermediate the cylinder ends are one or more intake ports 22 which connect through a transfer passage 23 with the crankcase 20 and one or more exhaust ports 24 connecting with an exhaust passage 26. The upper edge of the exhaust port is slightly above (that is, closer to the cylinder closed end) than the corresponding edge of the intake port 22. In the higher portion of the exhaust passage, the upper end 27 of a bypass passage 28 is located, having an opening 29 to the cylinder 12 in place of the exhaust port upper portion. The passage 28 further includes a connecting portion 30 extending from the end 27 to a lower end 31 with an opening 32 to the cylinder 12 adjacent to the crankcase 20. A flapper or reed check valve 33 is optionally and preferably disposed in the lower end 31 to prevent backflow from the crankcase.

Operation

In operation, the porting arrangement of FIGS. 1–3 directs part or all of the blowdown gases back to the engine crankcase 20. A splitter vane 34 of the bypass 28, upper section 27 separates the upper section of the exhaust port from the lower section. In the connecting portion 30, a flow passage crossing the exhaust port lower section connects the upper section of end 27 to an internal passage 31 leading to the opening 32 in the engine cylinder. The spacing between the upper and lower openings 29, 32 into the cylinder 12 is located so that when the upper opening 29 is about to be uncovered by the upper face of the piston 14 the lower opening 32 is just beginning to be covered by the piston skirt. Thus when the upper port 29 is fully opened the lower one 32 is totally or almost totally closed.

It is not necessary that the upper section opening 29 be directly above the exhaust port 24. It could be a completely different or separate port. Furthermore, the passage 30 to the lower opening may be skewed, i.e., it is not necessary for the upper and lower cylinder openings 29, 32 to be positioned at the same angular orientation.

As the piston 14 moves downward on the power stroke the piston skirt permits the bypass port opening 32 below the piston to remain completely uncovered until the top surface of the piston begins to uncover the upper opening 29. The blowdown process proceeds as the upper port 29 is uncovered and as the lower port 32 is covered, with flow being directed from the cylinder 12 into the crankcase 20. Crankcase pressure is nearing its maximum value at this time, and the cylinder blowdown will tend to increase this value. Either the lower port should be covered before the cylinder pressure falls below that in the crankcase, or the check valve 33 should be inserted in the bypass port which will prevent flow out of the crankcase. Both intake and exhaust ports 22, 24 should be timed to open at about the same crank angle and at a crank angle for which the crankcase pressure exceeds cylinder pressure. Continued piston motion then permits cylinder scavenging in the normal manner.

Piston motion during compression, depending upon operating conditions, may cause the crankcase pressure to fall below that in the cylinder. If so, reverse flow through both transfer and bypass passages 23, 28 will occur. In the conventionally scavenged engine, gas will be forced from the cylinder into the exhaust system. This can result in significant cooling of the exhaust gas and reduce the effectiveness of the catalytic converter, especially during a cold start. An important function of the bypass flow passage 28 is to direct this flow of cold gas into the crankcase 14. After closure of the bypass port 29 the compression process, fuel injection, ignition, combustion and expansion process will proceed as in a conventionally ported engine.

Two major advantages should be realized in using the bypass porting system just described. First, the initial blowdown, comparatively richer in unburned and partially burned fuel, will not be discharged into the exhaust system, i.e., engine-out hydrocarbon emissions will be reduced. Second, by directing the unburned charge exiting the cylinder during the compression process to the crankcase, the exhaust gas temperature will be increased improving the performance of the catalytic converter. An additional advantage is that this arrangement will permit fuel to be introduced earlier in the cycle without the concern that raw fuel might escape into the exhaust.

Alternative Embodiments

Figure 4:
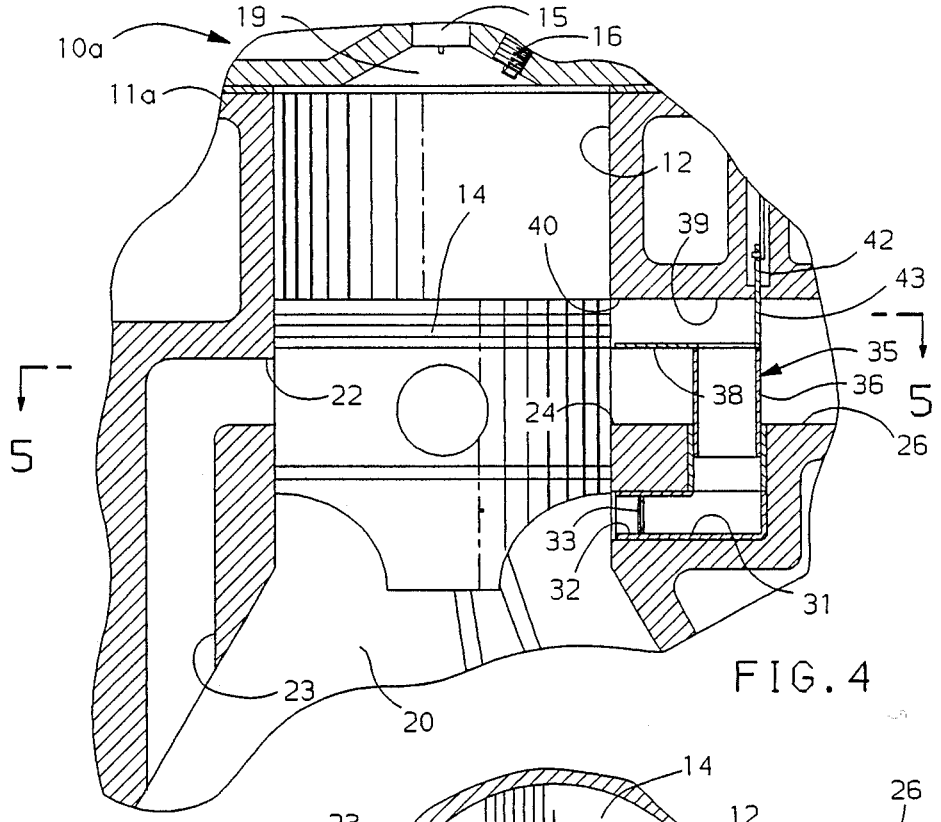
FIGS. 4–6 are views similar to FIGS. 1–3 showing an alternative engine embodiment with adjustable timing port bypass means.
Figure 5:
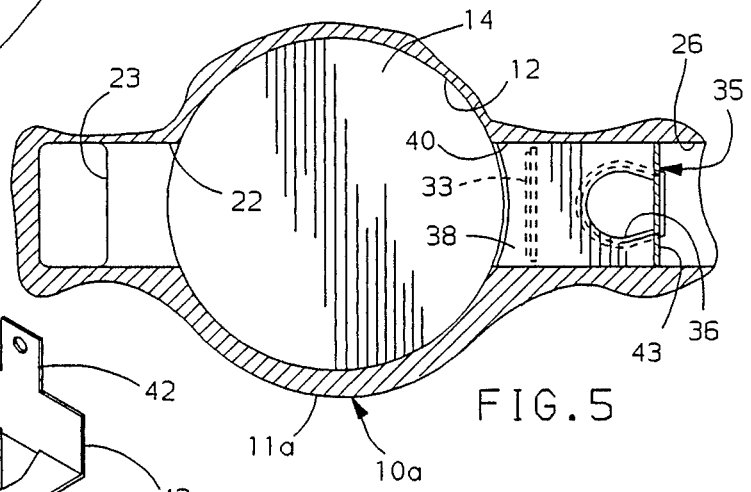
Figure 6:
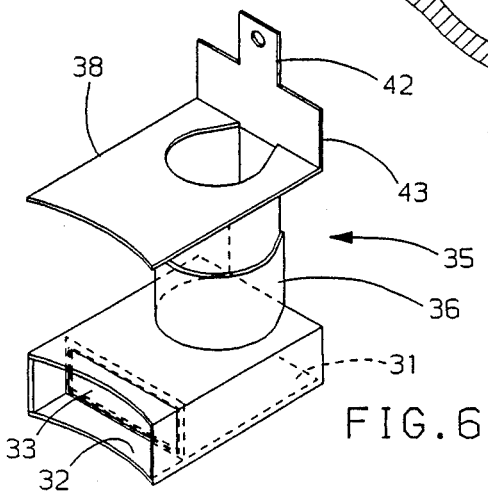

Inclusion of an automatically operated check valve has already been suggested above to prevent flow from the crankcase into the cylinder. However, other modes of engine operation, steady-state or in a transient, may be met wherein it may be desirable to vary the timing of the bypass event. FIGS. 4–6 show a modified engine 10*a* with a block 11*a* and an arrangement adapted to vary the bypass port timing in which like numerals identify parts like those previously described.

The primary differences from the first-described arrangement lie in the bypass passage 35, which includes a telescoping duct 36. This duct connects with a splitter vane 38 that separates from the exhaust passage 26 and port 24, the upper end 39 of the bypass passage 35 and its upper opening 40 into the cylinder 12. The lower end 31 of the passage 35 and its opening 32 into the cylinder 12 are as in the first embodiment.

A tang 42 on the rear wall 43 of the splitter vane 38 provides for connecting the telescoping duct to a suitable control by which the height of the splitter vane 38 may be varied. In this manner, the timing of the bypass period and exhaust passage opening may be varied as desired.

Figure 7:
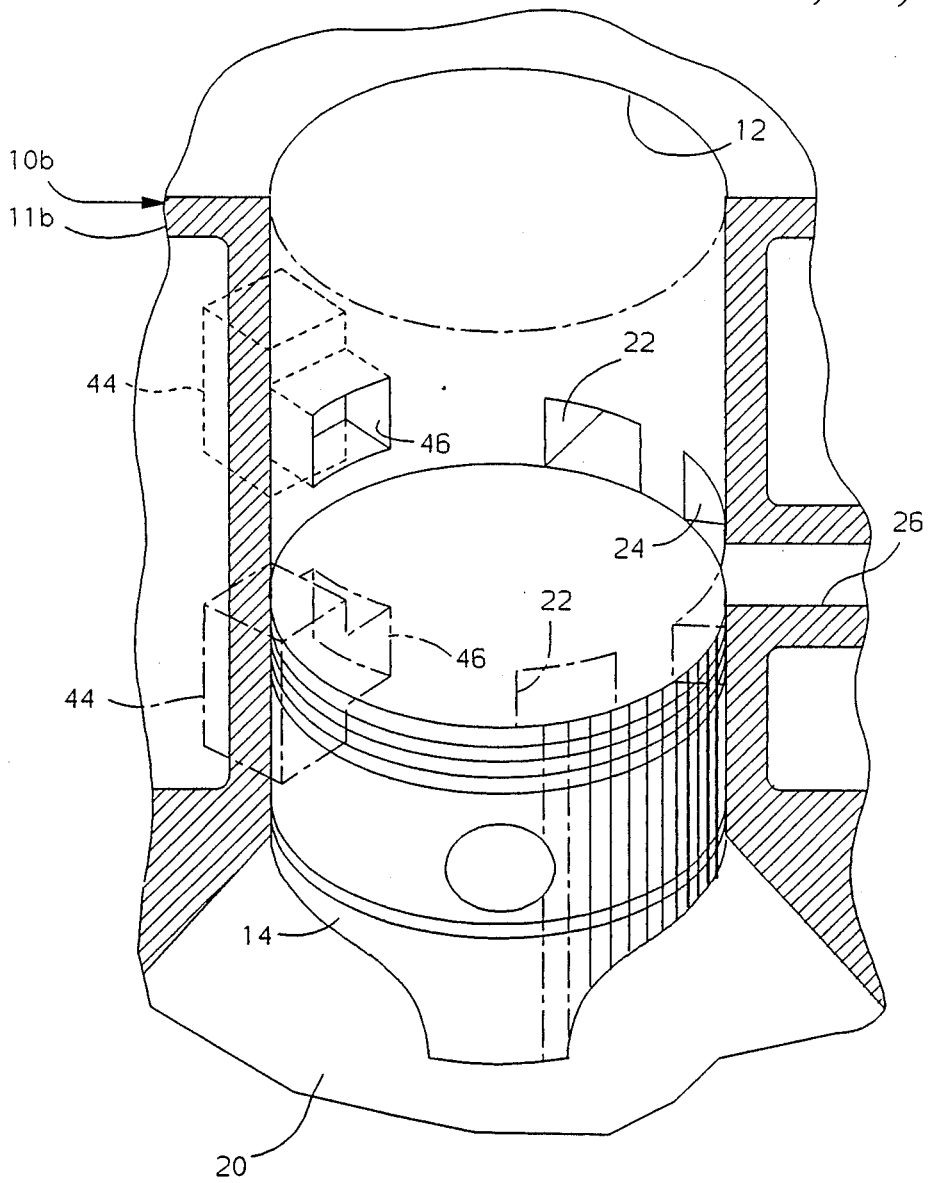
FIG. 7 is a schematic pictorial view of an alternative embodiment with blind blowdown ports.

Some benefit may also accrue from employing a blind cavity in place of the transfer passage. The blind cavity, if appropriately placed, could serve as a storage plenum of emissions-rich exhaust products and, by discharging during the initial phase of the scavenging process, could be used to deflect fresh charge away from the exhaust passage. One such configuration is shown schematically in FIG. 7 wherein plenums 44 are connected by blind blowdown ports 46 to the cylinder 12 above the intake and exhaust ports 22,24.

Figure 8:
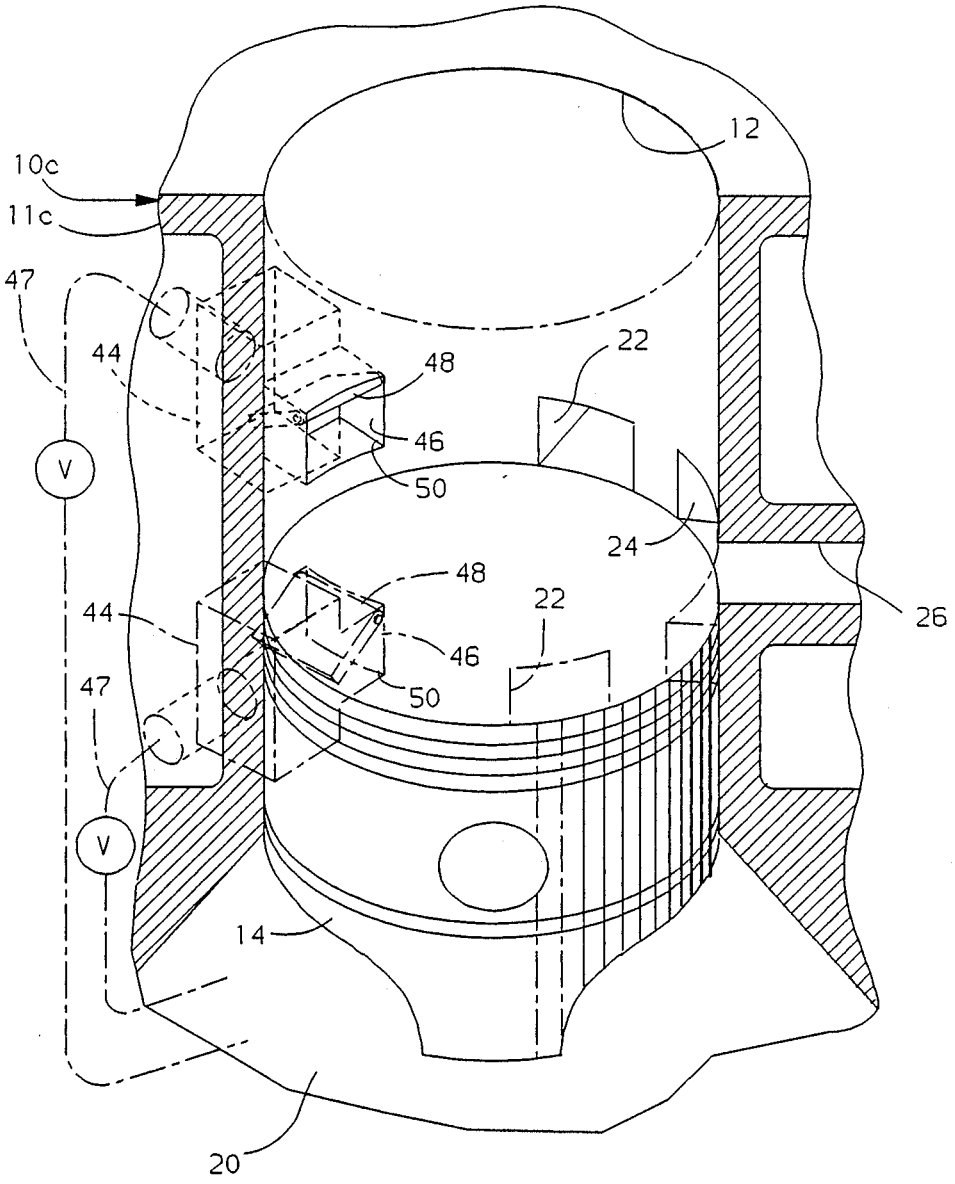
FIG. 8 is a schematic cross-sectional view showing a variation of the FIG. 7 embodiment.

Another option results if plenums 44 as shown in FIG. 8 are connected by valved passages 47 to the crankcase 20 and if a valve 48 is interposed between each port opening 50 in the cylinder 12 and the plenum 44. Then by closing the valve 48 between plenum and cylinder and opening the passage 47 between the plenum and crankcase, the volume of the crankcase 20 is increased, which leads to a reduction in maximum crankcase pressure. For low speed operation this tends to increase the mass of fresh charge trapped in the combustion chamber. If both valves are opened, a bypass porting configuration exists. When both valves are closed, there is an effective change in exhaust port timing.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

The embodiments of the invention in which an exclusive property or privilege is claimed are defined as follows:

1. A two cycle crankcase scavenged engine having a cylinder with intake and exhaust ports controlled by a piston to open at about the same point of piston motion, and an auxiliary port opening to the cylinder above the exhaust port and connected through a passage with a plenum to transfer exhaust blowdown gas to the plenum for later return to the cylinder at a lower pressure period of the cylinder cycle, said piston continuously closing the auxiliary port opening during compression and expansion piston motions of each cycle.

2. A two cycle crankcase scavenged engine having a cylinder with intake and exhaust ports controlled by a piston to open at about the same point of piston motion, and a bypass port opening to the cylinder above the exhaust port and connected through a bypass passage with the crankcase to transfer exhaust blowdown gas to the crankcase, said bypass passage having valve means to prevent reverse flow from the crankcase to the cylinder.

3. A two cycle engine as in claim 2 wherein said bypass port is disposed within the exhaust port and has a lower wall that effectively forms an upper wall for the exhaust port, said lower/upper wall being axially adjustable to vary the timing of opening of the exhaust port.

4. A two cycle crankcase scavenged engine as in claim 1 wherein said plenum comprises the engine crankcase.

5. A two cycle crankcase scavenged engine as in claim 1 wherein the plenum is separate from the engine crankcase, and further including bypass means communicating the plenum with the crankcase whereby blowdown gas may be transferred to the crankcase.

6. A two cycle crankcase scavenged engine as in claim 5 and further including first and second valves in said auxiliary port passage and said bypass means respectively and operable to control communication of the plenum with the cylinder and the crankcase.

7. A two cycle crankcase scavenged engine as in claim 2 wherein said valve means comprises a check valve associated with the bypass passage.

8. A two cycle crankcase scavenged engine as in claim 2 wherein said valve means comprises a skirt portion of the piston.

9. A two cycle crankcase scavenged engine as in claim 8 wherein one end of the bypass passage is closed by the piston at both extreme of the piston travel and both ends of the bypass passage are open during a range of intermediate positions reached shortly in advance of the opening of the intake port.

* * * * *